United States Patent [19]

Moore

[11] 4,081,635

[45] Mar. 28, 1978

[54] ELECTRICAL SWITCH RESPONSIVE TO A PREDETERMINED FLUID FLOW

[75] Inventor: Edward H. Moore, Avon, Conn.

[73] Assignee: DeLaval Turbine Inc., Princeton, N.J.

[21] Appl. No.: 668,509

[22] Filed: Mar. 19, 1976

[51] Int. Cl.[2] ..... H01H 35/38

[52] U.S. Cl. ..... 200/81.9 M; 200/82 E; 137/494

[58] Field of Search ..... 73/249; 335/205; 137/494, 535, 540; 200/81 R, 81.4, 81.9 M, 81.9 R, 82 R, 82 E

[56] References Cited

U.S. PATENT DOCUMENTS

| | | | |
|---|---|---|---|
| 2,892,051 | 6/1959 | Moore | 200/81.9 M |
| 3,297,843 | 1/1967 | Hoss | 200/81.9 M |
| 3,338,263 | 8/1967 | Altmeppen | 137/494 |
| 3,452,776 | 7/1969 | Chenoweth | 137/494 |
| 3,507,359 | 4/1970 | Warnock | 200/81.9 M |
| 3,551,620 | 12/1970 | Hoover | 200/81.9 M |
| 3,562,455 | 2/1971 | McQueen | 200/81.9 M |
| 3,792,714 | 2/1974 | Miller | 137/494 |

*Primary Examiner*—Gerald P. Tolin

*Attorney, Agent, or Firm*—Hopgood, Calimafde, Kalil, Blaustein & Lieberman

[57] ABSTRACT

The invention contemplates an improved flow switch providing an electrical output which is indicative of whether or not a predetermined flow or no-flow condition exists in an hydraulic line. In all its disclosed embodiments, the invention features simplicity of construction and a minimum of impedance to hydraulic flow, by reason of a straight-through flow alignment between inlet and outlet ports.

19 Claims, 8 Drawing Figures

R-L
L-R

ELECTRICAL SWITCH RESPONSIVE TO A PREDETERMINED FLUID FLOW

This invention relates to flow-indicating devices of the general character represented by my U.S. Pat. No. 2,892,051.

In devices of the character indicated, a valve member or shuttle is caused to assume a valve-opening position which is a measure of flow rate in an hydraulic line; and a magnetized element carried by the shuttle coacts with a fixedly mounted magnetically sensitive electric switch, to provide for switch operation which will be indicative of the existence or not of the desired flow condition. Past constructions have employed traditional valve-body castings; operation has been characterized by turbulence and a tendency to accumulate foreign matter, both to the detriment of switch reliability and performance.

It is accordingly an object of the invention to provide an improved flow-switch construction, avoiding or substantially reducing the noted difficulties with past constructions.

A specific object is to meet the above with a construction which inherently presents substantially no restriction to hydraulic flow.

Another specific object is to achieve the above objects with a construction which provides an essentially straight-through passage for hydraulic flow.

A further specific object is to meet the foregoing objects with a construction which does not require casting in manufacture.

A general object is to achieve simplicity, reliability and low cost in an improved flow-switch construction.

Other objects and various further features of novelty and invention will be pointed out or will occur to those skilled in the art from a reading of the following specification in conjunction with the accompanying drawings. In said drawings, which show for illustrative purposes only, preferred forms of the invention:

Figures 1, 2, 3, 4, 5, 6, 7, 8:
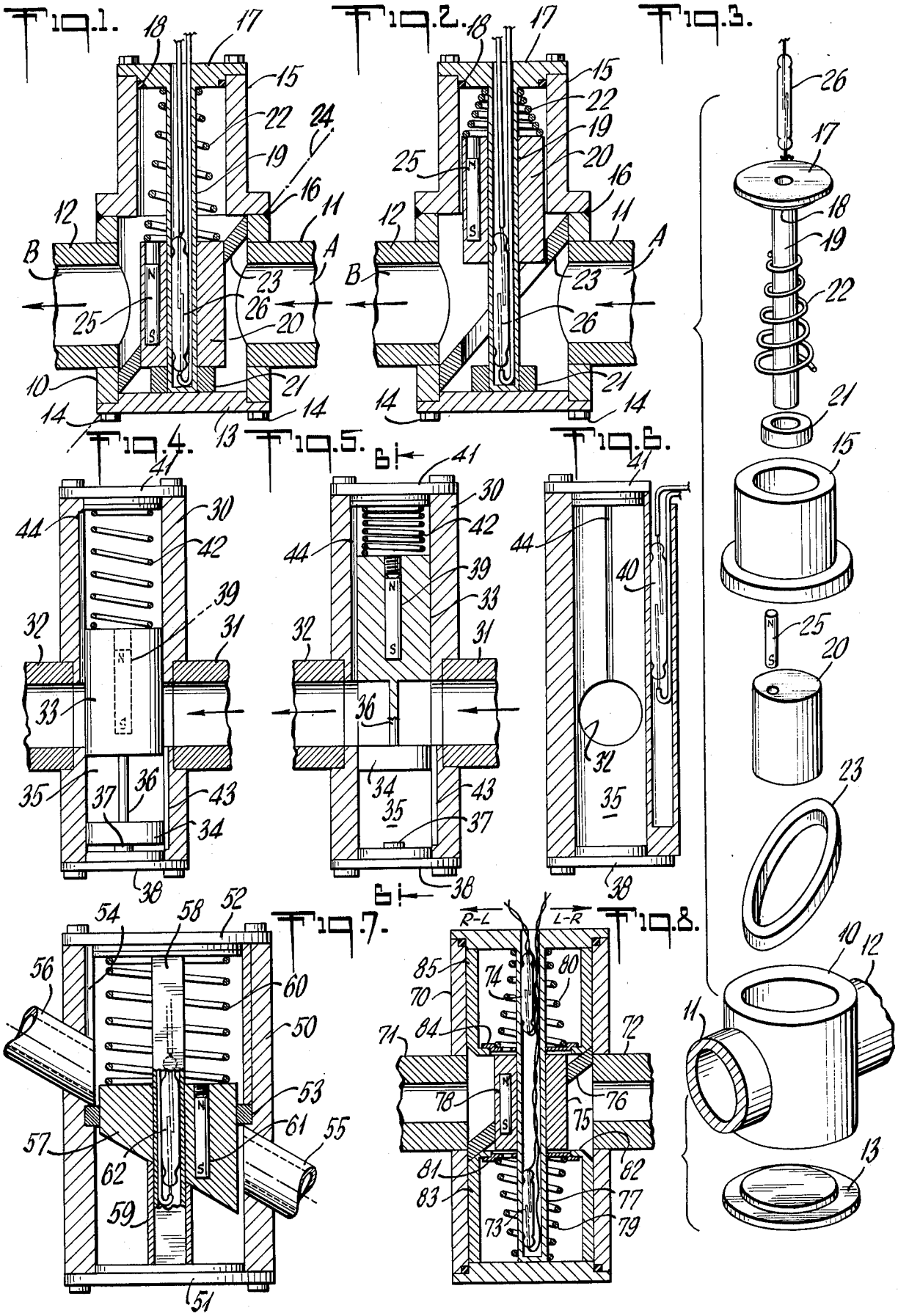
FIG. 1 is a vertical sectional view through a flow-switch construction of the invention, shown for the no-flow relation of parts.
FIG. 2 is a view similar to FIG. 1 to show the full-flow relation of parts.
FIG. 3 is an exploded view in perspective for the parts of the construction of FIGS. 1 and 2.
FIGS. 4 and 5 are vertical sectional views corresponding to FIGS. 1 and 2 but for another embodiment of the invention.

FIG. 6 is a sectional view of the body portion of the structure of FIGS. 4 and 5, taken at the plane 6—6 designated in FIGS. 4 and 5; and FIGS. 7 and 8 are views similar to FIGS. 1 and 4, to show a further embodiment.

The flow-indicator switch of FIGS. 1 to 3 comprises a valve body having an internal cavity between aligned bores of inlet and outlet ports, designated A—B, for responding to hydraulic flow in the direction shown by arrows. While the body may be a casting, I prefer and have shown the use of cut sections and lengths of tubing. Thus, a first elongate cylindrical tube member 10 establishes the principal body part, and like tubing elements 11–12, of lesser diameter, are secured to member 10, in alignment with each other to define the respective ports A—B and their access to the cavity defined by body member 10. A lower cap 13 may permanently close one end of body member 10, but selective removability is suggested at 14. The upper end is completed by a flanged tubular member 15 secured as by welding 16 to member 10, and closed by a removable cap 17 having a sealed engagement at 18 to the bore of member 15. Cap 17 is concentrically referenced to the bore of member 15 and constitutes the mounting means for a hollow central elongate cylindrical guide stem, which is closed at its lower end and open at its upper end.

Stem 19 provides stabilized guidance for free axial movement of a valve member, piston or shuttle 20. Shuttle 20 is movable between a first position (FIG. 1) and a second position (FIG. 2) by flow and pressure conditions to be described. A small sleeve 21, which may have light frictional engagement to the lower end of stem 19, assumes its position on stem 19 in the process of assembling and securing cap 17 to member 15; thereafter, sleeve 21 serves as a stop to determine the lower position of shuttle 20, as urged by gravity or by spring means 22.

The fluid-exposed structure is completed by a bridge member or formation 23 which may be a sleeve having parallel ends which are bias-cut from cylindrical tubing, of outer diameter to fit the bore of tube 10 and of inner diameter for running clearance with the outer cylindrical surface of shuttle 20; spot welds to member 10 and at spaced locations (not shown) may retain sleeve 23 in the position shown. The general plane of orientation of sleeve 23 is designated 24 and is seen to intersect the intersection of the axis of tube 10 with that of ports A—B, being at an acute angle to and therefore intermediate the directions of these axes. Preferably, the diameter of the valve member or shuttle 20 is substantially the same as the bore diameter of ports A—B and the slope 24 of orientation of sleeve 23 is selected such that in the raised (FIG. 2) position of shuttle 20, there will be a straight-through passage between ports A—B. Stated in other words, the geometrical cylinder defined by and between the bores of ports A—B is substantially uncut by the bore of sleeve 23.

For electrical response to a given flow condition (shuttle-elevation position), I make use of a permanently polarized magnet element, such as a rod element 25, carried by the shuttle 20, and fixedly mounted magnetically responsive switch means 26, shown mounted in the hollow of stem 19. Switch means 26 is preferably of the hermetically sealed magnetic-reed variety; if mounted at the upper end of stem 19, it will provide desired switch operation for shuttle proximity in the high or full-flow hydraulic situation, but in the lower-mounted position of FIGS. 1 and 2, it responds to the lower no-flow, or substantially no-flow, situation depicted in FIG. 1. The sealed assembly of means 26 may be potted in the hollow of stem 19, with flexible leads 27 brought out through cap 17 for external circuit connection, as desired.

In use, the flow switch of FIGS. 1 to 3 will be seen at all times to provide equal-area exposure to hydraulic pressure at both ends of the valve member or shuttle 20. Initially, for the closed or no-flow condition of FIG. 1, gravity or (in the case of spring 22) the spring 22 will urge this position, in the absence of a sufficient predominance of inlet pressure $P_1$ over outlet pressure $P_2$. When pressure $P_1$ has such predominance, the valve member or shuttle is driven upward, thus opening a flow passage beneath shuttle 20 and through the bridge formation or sleeve 23. In the course of this upward movement, magnet 25 ceases to be operative upon switch means 26, so that its state changes, by an opening of its contacts. The elevation of shuttle 20 remains a function of the pressure drop $P_1 - P_2$, the hydraulic passage being full open at 23 and straight-through between ports A—B, for the full-flow situation shown in FIG. 2. With reduced flow or no flow, the device returns to its FIG. 1 condition, and the contacts of switch 26 again close, to reflect this fact.

With the exception of magnet 25 and the reed elements of switch 26, all described parts may be non-magnetic, although not necessarily so. However, stem 19 and shuttle 20 should both be of non-magnetic material such as aluminum or a suitable molded plastic, e.g., polypropylene.

The embodiment of FIGS. 4 to 6 differs from that of FIGS. 1 to 3 in that the valve member or shuttle pilots on the cylindrical bore of the body tube member 30, on both sides of the potential through-passage between aligned tubular inlet and outlet ports 31–32. The valve member (shuttle) is shown to comprise spaced upper and lower cylindrical portions 33–34 having guided running clearance with the cylindrical bore surface 35 of body tube 30, and a central stem or rod portion 36 of very substantially reduced section interconnects the guided portions 33–34, the length of rod portion 36 being substantially the bore diameter of ports 31–32. In the lower positon of FIG. 4, the more elongate shuttle portion 33 blocks fluid passage between ports 31–32, the lower portion 34 being shown stopped by a small pedestal 37 in the bottom closure 38. In the upper position of FIG. 5, the passage between ports 31–32 is fully open and straight-through, except for the negligible presence of rod portion 36, it being noted that if rod portion 36 is only slightly in excess of the bore diameter of ports 31–32, or if the outer diameter of the shuttle only slightly exceeds the bore diameter of ports 31–32, there need be no loss of section area available to the hydraulic flow even at passage by the rod section 36.

The construction shown in FIGS. 4 to 6 is completed by a polarized magnet element 39 in a central hole at the upper cylindrical shuttle portion 33, and by magnetic-reed switch means 40 potted in a bore in the tubular body member 30. A cap 41 closes the upper end of body element 30, and a spring 42 between cap 41 and the shuttle is optional and dependent upon use, as with the embodiment of FIGS. 1 to 3.

To assure fast response in use, a first direct fluid passage 43 is provided from inlet 31 to the lower end of the shuttle, to the exclusion of the upper end of the shuttle; and a second direct fluid passage 44 is provided from the outlet 32 to the upper end of the shuttle, to the exclusion of the lower end. As shown, these passages are longitudinally extending local grooves in the otherwise circumferentially continuous cylindrical bore of body member 30. Under no-flow conditions, pressures on the opposite ends of the shuttle are the same, so that gravity or spring 42 (as the case may be) returns the shuttle to the FIG. 4 position, with switch contacts at 40 unaffected by magnet 39 and therefore open. At onset of the hydraulic flow, the predominance of inlet over outlet pressure is such (as presented to the shuttle ends via passages 43–44) as to elevate the shuttle; and at full flow, or approach thereto, magnet 39 is operative to close the contacts of switch 40. Again, the parts containing or carrying the magnetic means 39–40, i.e., body member 30 and the shuttle, are preferably of non-magnetic material.

In the embodiment of FIG. 7, the body member 50 is again tubular, being capped at its ends 51–52. A bridge member or sleeve 53 is centrally retained at the lower end of a counterbore 54 with its general plane of orientation normal to the body axis. Inlet and outlet ports 55–56 are on an alignment 57 which passes through the general plane of bridge sleeve 53 and the body axis, the bore of sleeve 53 being of such diameter and limited axial extent as to present no or substantially no interference with the geometrical cylinder defined by and between inlet and outlet bores at 55–56. A valve member or shuttle 57 has an external cylindrical surface for running clearance with the cylindrical bore of sleeve 53, being truncated at its lower end to accord with the slope of the port alignment 57. To preserve angular orientation of shuttle 57, it has a suitably keyed engagement to its guide stem 58, forming part of the closure 52, and a suitably truncated sleeve 59 having friction fit to the lower end of stem 58 serves as a stop for the no-flow condition depicted in FIG. 7, the same being urged by gravity or by spring 60, as the case may be. As shown, the keyed engagement results from use of one or more elongate flats along stem 58, the shuttle bore being broached as appropriate for such engagement. Magnet and switch elements 61–62 are shuttle and stem mounted, as described for FIGS. 1 to 3. Operation is also generally as described for FIGS. 1 to 3, it being again characteristic that a straight-through passage is available for the full-flow hydraulic condition.

The embodiment of FIG. 8 illustrates application of the invention to a bi-directional flow situation, wherein a predetermined fluid flow through body 70 is either left-to-right from port connection 71 to port connection 72, or is right-to-left from port connection 72 to port connection 71, the applicable one to the exclusion of the other of these conditions being indicated by magnetic-switch closure at 73 or at 74, as suggested by "L-R" and "R-L" notation and directional arrows. Construction of body 70 will be seen to be elongate cylindrical and to resemble constructions already described, the important difference being that the shuttle or valve member 75 (which coacts with an inclined fixed bridge or sleeve 76) is guided by stem 77 to a raised or to a lowered position, depending upon the directional sense of a flow-induced pressure drop across the device.

As with the other described embodiments, the shuttle 75 is non-magnetic and carries a polarized magnet element 78 which will function to close contacts of a first reed switch 74 in the shuttle-raised position in response to R-L flow, and which will function to close contacts of the other reed switch 73 in response to L-R flow. A first spring 79 of two like springs (79–80) transmits resilient elevating force to shuttle 75 via a movable cup 81, for all lower positions of shuttle 75; the rim of cup 81 being stopped at a lug or shoulder formation 82 in an insert sleeve 83 forming part of the lower body structure. Thus, spring 79 is continuously operative to urge shuttle 75 to (but no further than) its central or no-flow position shown. In similar fashion, the upper spring 80 transmits its resilient force to shuttle 75 in the opposite direction via cup 84 and is continuously operative to urge shuttle 75 to (but no further than) its central or no-flow position shown, being limited by the lug formation of a similar insert sleeve 85 in the bore of the upper part of body 70.

Whatever the flow direction, and with a flow of sufficient magnitude, the shuttle 75 will be displaced as appropriate and to a limiting position wherein a straight-through passage exists between port connections 71–72, with clear electric-switch operation of separate indicating circuit connections, served by the separate twisted-pair leads shown in association with the legends "R-L" and "L-R", respectively. And, of course, for no-flow or substantially no-flow conditions, neither switch will be operated because the shuttle will be in its central position, as shown.

It will be seen that I have described flow-switch constructions meeting all stated objects. Aside from achieving performance and durability by provision for straight-through hydraulic flow, my structures all represent substantial simplification from the viewpoint of manufacturing cost. In particular, the bridge formation or sleeve is provided with extreme simplicity and effectiveness without resorting to casting, and the complexity of internal coring that would then be involved. Moreover, my results are achieved with relatively little close-tolerance machining, and standard tubing such as aluminum extrusions may be used to a large extent only by cutting-off or truncating operations. My constructions also lend themselves to a wide variety of materials and design variations. In all cases, the bulk of the flow passes beneath the piston or shuttle and not around or through it, so that flow through the device is relatively free of deflection or excessive pressure drop.

While the invention has been described in detail for the preferred forms shown, it will be understood that modifications may be made without departure from the scope of the invention. It will, for example, also be understood that for simplicity of explanation, the shuttle or valve member has been described in terms of a full-open or a full-closed position, whereas of course any given position or operation of the shuttle will be a function of the extent to which pressure differential across the device is able to effect a displacement. Thus, shuttle displacement for partial openings of the inlet-outlet passage will be in direct relation to the rate of flow until the full-open condition is achieved, and the selection of spring stiffness at 22-42-60-79-80 will determine the flow-rate change necessary to effect operation of the associated magnetic-reed switch; moreover, by longitudinal placement of the reed switch at a selected point between the full-open and full-closed position, the device can be made to switch-monitor desired threshold flow rates less than that for the full-flow condition.

What is claimed is:

1. A flow-indicator switch, comprising a valve body having an internal cavity between aligned bores of inlet and outlet ports, a valve member having an elongate external circumferentially continuous cylindrical surface, guide means coacting between said body and valve member for guiding said valve member on an axis transverse to the alignment axes of said ports between a first position substantially intercepting the geometrical figure defined by and between the bores of said ports and a second position substantially removed from said first position, said body including a bridge member within the cavity of said body and oriented generally in a plane intermediate the alignment axis of said ports and the valve-member guide axis, said bridge member in said plane fully traversing both said geometrical figure and the path of movement of said valve member and having a bore in clearance relation with said path of movement, polarized magnetic means carried by said valve member, and magnetically sensitive electric switch means carried by said body at a location to respond to proximity of said magnetic means near one to the exclusion of the other of said valve-member positions.

2. A switch according to claim 1, in which said body is generally cylindrical tube concentric with the valve-member guide axis and of larger bore diameter than the diameter of said valve member, and in which said bridge member comprises a cylindrical sleeve fitted to the bore of said tube and having a bore in clearance with the path of movement of said valve member, the ends of said sleeve being truncated substantially parallel to said intermediate plane.

3. A switch according to claim 1, in which said body includes a generally cylindrical tube concentric with the valve-member guide axis, said tube extending laterally offset from said geometrical figure to an extent accommodating the second position of said valve member.

4. A switch according to claim 3, in which said body further includes a removable closure fitting for the laterally offset end of said tube, the body element of said guide means comprising an elongate guide stem carried by said closure fitting and extending within said cavity and through said geometrical figure, said valve member having a bore guided by said stem.

5. A switch according to claim 4, in which said electric switch means is carried with said stem.

6. A switch according to claim 5, in which said electric switch means is positioned substantially and effectively at the first and said valve-member positions.

7. A switch according to claim 1, and including spring means reacting between said body and said valve member and normally urging said valve member in the direction of the first position thereof.

8. A switch according to claim 1, in which the bore of said bridge member circumferentially continuously surrounds the port-alignment projection of said geometrical figure.

9. A switch according to claim 8, in which the alignment of said ports is substantially normal to the axis of the cylindrical bore.

10. A switch according to claim 8, in which the alignment of said ports is at an acute angle to the axis of the cylindrical bore.

11. A switch according to claim 8, in which said bridge formation is in a general plane of orientation at an acute angle to and intermediate the respective axial orientations of said ports and of the cylindrical bore.

12. A switch according to claim 8, in which said bridge formation is in a general plane of orientation that is substantially normal to the axis of the cylindrical bore, the axial orientation of the port alignment passing through said substantially normal plane at substantially the intersection of the cylindrical bore axis therewith.

13. A switch according to claim 1, in which said electric-switch means is of the hermetically sealed magnetic-reed variety.

14. A flow-indicator switch, comprising a valve body having an internal cavity between aligned bores of inlet and outlet ports, a valve member having an elongate external circumferentially continuous cylindrical surface, guide means coacting between said body and valve member for guiding said valve member on an axis transverse to the alignment axes of said ports between a first position substantially intercepting the geometrical figure defined by and between the bores of said ports and a second position substantially removed from said first position, said guide means being also sufficiently elongate to guide said valve member for displacement to a third position substantially removed from said first position and in the direction opposite from that of said second position, said body including a bridge member within the cavity of said body and oriented generally in a plane intermediate the alignment axis of said ports and the valve-member guide axis, said bridge member in said plane fully traversing both said geometrical figure and the path of movement of said valve member and having a bore in clearance relation with said path of movement, polarized magnetic means carried by said valve member, and magnetically sensitive electric switch means carried by body at a location to respond to proximity of said magnetic means near one to the exclusion of other of said valve-member positions.

15. A switch according to claim 14, in which said electric switch means includes a first magnetically sensitive switch means to respond to proximity of said magnetic means near one to the exclusion of the others of said positions, and a second magnetically sensitive switch means to respond to proximity of said magnet means near another of said positions.

16. A switch according to claim 15, in which said first and second switch means are positioned to respond to proximity of said magnetic means near said second and third positions, respectively.

17. A switch according to claim 15, in which said guide means is a hollow stem within which said respective switch means are mounted in longitudinally spaced relation.

18. A switch according to claim 14, and including first spring means reacting between said body and said valve member and urging said valve member in the direction from the second to the first position thereof, and second spring means reacting between said body and said valve member and urging said valve member in the direction from the third to the first position thereof.

19. a switch according to claim 18, and including body-referenced stop means effectively limiting action of said first spring means for valve-member displacements between said first and second positions, said body-referenced stop means also effectively limiting action of said second spring means for valve-member displacements between said first and third positions.

* * * * *